US005886955A

United States Patent [19]

Magnasco

[11] Patent Number: 5,886,955

[45] **Date of Patent: *Mar. 23, 1999**

[54] PERSONAL ELECTRONIC CLOCK RELATED DEVICE WITH A LIMITED AUTOMATIC MULTIPLE RECALL ALARM SUSPENSION CONTROL MEANS

[76] Inventor: Peter L. Magnasco, P.O. Box 173, Campbell, Calif. 95009

[ * ] Notice: This patent issued on a continued prosecution application filed under 37 CFR 1.53(d), and is subject to the twenty year patent term provisions of 35 U.S.C. 154(a)(2).

[21] Appl. No.: 326,937

[22] Filed: Oct. 21, 1994

[51] Int. Cl.[6] ..... G04B 22/08

[52] U.S. Cl. ..... 368/248; 368/244

[58] Field of Search ..... 368/245, 256, 368/248–279

[56] References Cited

U.S. PATENT DOCUMENTS

| | | | |
|---|---|---|---|
| 1,858,563 | 5/1932 | Schlenker | 368/245 |
| 3,681,916 | 8/1972 | Itoyama et al. | 368/245 |
| 3,715,879 | 2/1973 | Cielaszyk | 368/248 |
| 3,733,802 | 5/1973 | Wisser | 368/248 |
| 3,825,836 | 7/1974 | Pyles | 325/396 |
| 3,855,574 | 12/1974 | Welty | 368/248 |
| 3,900,798 | 8/1975 | Pomerantz et al. | 325/396 |
| 4,060,973 | 12/1977 | Martino | 368/245 |
| 4,426,736 | 1/1984 | Fisler | 455/231 |

FOREIGN PATENT DOCUMENTS

| | | | |
|---|---|---|---|
| 0339316 | 11/1989 | European Pat. Off. | 368/245 |
| 1903715 | 8/1970 | Germany | 368/248 |
| 2615945 | 10/1977 | Germany | 368/248 |
| 0044575 | 4/1979 | Japan | 368/248 |
| 0122983 | 9/1981 | Japan | 368/256 |
| 0088679 | 5/1984 | Japan | 368/248 |
| 01424487 | 6/1989 | Japan | 368/245 |
| 0143996 | 6/1989 | Japan | 368/245 |

*Primary Examiner*—Bernard Roskoski

[57] ABSTRACT

The combination of a personal electronic clock related device with a limited automatic multiple recall alarm suspension control means comprising an involuntary alarm suspension control circuit including an extended audio control means and a governing means. The personal electronic clock related device having internal audio alarm control means and internal sound emission means for allowing the emission of an audible alarm call sound to be broadcast at a set time. The extended audio control means is coupled with the internal audio alarm control means, and further coupled with the internal sound emission means interrupting the emission of the audible alarm call sound from being broadcast. The governing means is jointly coupled with the internal audio alarm control means and simultaneously activated when the audible alarm call sound is to be broadcast. The governing means including primary and secondary output control means cooperatively allowing an involuntary control signal to be discharged. The extended audio control means is further coupled in connection with and activated by the involuntary control signal for allowing the emission of the audible alarm call sound to be broadcast. The primary output control means are arranged specifically allowing the audible alarm call sound to be very infrequently momentarily broadcast for extremely brief periods of time. The secondary output control means allowing the audible alarm call sound to be continuously broadcast after the audible alarm call sound has been accordingly broadcast a preceding number of times, whereby, for consistently allowing the emission of the audible alarm call sound produced by the personal electronic clock related device to be momentarily broadcast and then involuntarily suspended for a substantially lengthy period of time for a limited number of times prior to being continuously broadcast, according to the direction of the limited automatic multiple recall alarm suspension control means. The limited automatic multiple recall alarm suspension control means may further include a means for optionally allowing the personal electronic clock related device to be independently operated.

3 Claims, 3 Drawing Sheets

PERSONAL ELECTRONIC CLOCK RELATED DEVICE WITH A LIMITED AUTOMATIC MULTIPLE RECALL ALARM SUSPENSION CONTROL MEANS

The present invention relates to a personal electronic clock related device with a limited automatic multiple recall alarm suspension control means comprising an involuntary alarm suspension control circuit, consisting in its specific arrangement for use in combination with such a device.

BACKGROUND

1. Field of Invention

In recent years personal electronic clock related devices, such as personal electronic clock radio devices and alarm clocks, and the like, have continued to be made increasingly more desirable for use, at least in part, because of the many types of various electronic added control means that have been incorporated for use with such devices, which allow users a number of choices of how they may be awakened.

Many of these personal electronic clock related devices have typically allowed users to optionally be awakened by the sound of a radio playing rather than the audible alarm call sound, which may sometimes be rather harsh in nature. However, many users must depend upon being awakened by the audible alarm call sound to maintain the level of punctuality they require.

In spite of the number of electronic added control means which have been previously incorporated for use with such devices, many users may often experience some varying degree of annoyance or minor aggravation upon awakening as the emission of the audible alarm call sound proceeds to be broadcast before it can be silenced.

Therefore, the present invention is directed herein to the emission of the audible alarm call sound which may sometimes be rather harsh in nature that is broadcast by such devices, to allow users to possibly avoid the annoyance, or minor aggravation, briefly related upon which they may often experience during the use of such devices when the emission of the audible alarm call sound is broadcast.

2. Description of Prior Art

For example, some of the prior control means that may have previously been incorporated for use with such devices sometimes allow the emission of the audible alarm call sound to first be broadcast at a reduced level in sound, and then be gradually increased. However, users may still experience some degree of annoyance or minor aggravation upon awakening resulting from the ongoing emission of the audible alarm call sound, requiring the emission of the audible alarm call sound to be hastily silenced by the user. Others often allow the emission of the audible alarm call sound to be intermittently broadcast when it is invoked. However, the audible alarm call is customarily broadcast at relatively close intervals in time to allow users to be certain that they may maintain the level of punctuality they require, but in turn requiring the emission of the audible alarm call sound to be hastily silenced by the user upon awakening. Another allows the emission of the audible alarm call sound to first be intermittently broadcast before it is continuously broadcast. However, it is inclined to also be incorporated allowing the emission of the audible alarm call sound to immediately be broadcast at relatively close, or for prolonged intervals of time, which initially allows users to be highly susceptible of experiencing some varying degree of annoyance or minor aggravation upon awakening before the emission of the audible alarm call sound can be silenced by the user.

In view of the need which has continued to exist long after the arrival of these and similar types of control means, it would be desirable to provide an electronic added control means arranged specifically to allow users to possibly avoid the type of annoyance or minor aggravation which they may have often previously experienced described in the foregoing.

OBJECTS AND ADVANTAGES

Therefore, it is the primary object of the present invention to allow users to possibly avoid the type of annoyance or minor aggravation they may have often previously experienced related in the foregoing during the use of personal electronic clock related devices, and accordingly, to consist in the combination of a personal electronic clock related device with a limited automatic multiple recall alarm suspension control means comprising an involuntary alarm suspension control circuit, for consistently allowing the emission of the audible alarm call sound produced by the personal electronic clock related device to be momentarily broadcast and then involuntarily suspended for a substantially lengthy period of time for a limited number of times prior to being continuously broadcast, according to the direction of the limited automatic multiple recall alarm suspension control means.

It is the overall object of the present invention for the limited automatic multiple recall alarm suspension control means to specifically prohibit the emission of an audible alarm call sound from being immediately broadcast in a manner which may in any way possibly require it to be hastily silenced by the user.

It is a further object of the present invention that the limited automatic multiple recall alarm suspension control means may optionally allow the personal electronic clock related device to be independently operated.

It is yet another object of the present invention for the limited automatic multiple recall alarm suspension control means to be largely capable of being produced in integrated circuit form.

These together with other objects and advantages more fully describing the spirit and scope of the invention will become subsequently apparent, and are more fully hereinafter described and claimed, and reside in the following description and accompanying drawings.

In the following it may be seen that the radio sound could be used as the audible alarm call sound, since when in effect, the audible alarm call sound would then be the sound of the radio playing, however, the present invention is not concerned with it. Therefore, in the following description, and in the accompanying drawings, the present invention is directed to the emission of the audible alarm call sound which may sometimes be rather harsh in nature.

DRAWING FIGURES

BRIEF DESCRIPTION OF THE INVENTION

Figure 1:
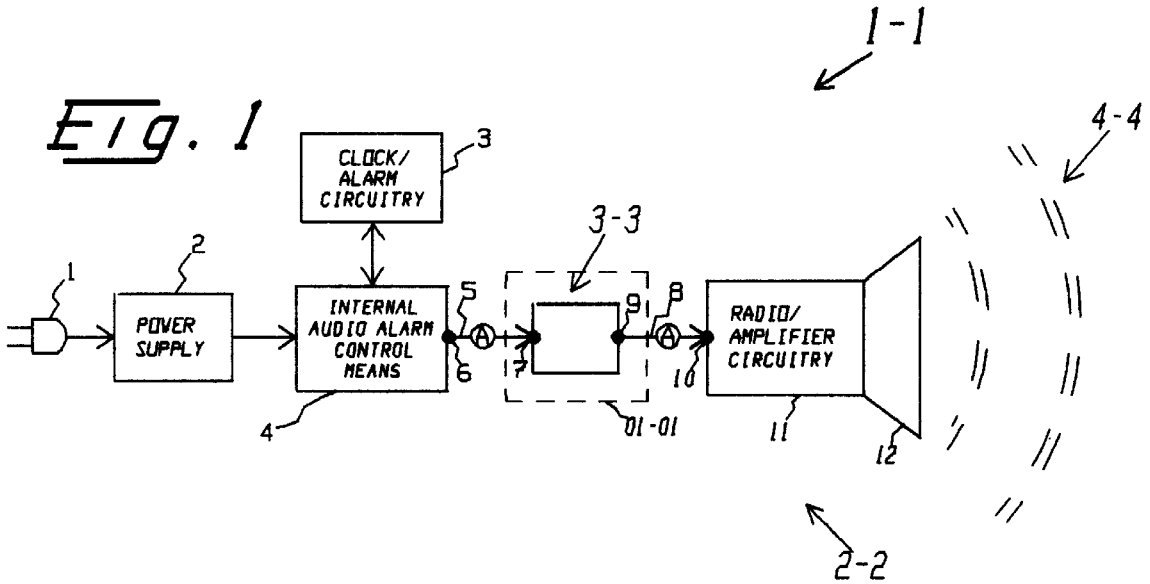
FIG. 1 is a block diagram of the present invention 1—1, as generally designated.

With attention now invited to FIG. 1 of the accompanying drawings, the present invention 1—1 is shown in block diagram form.

In accordance with the present invention 1—1, in FIG. 1 such a personal electronic clock related device is shown for example in the form of a personal electronic clock radio device 2—2. The personal electronic clock radio device 2—2 is shown including a limited automatic multiple recall alarm suspension control means 3—3, shown within the area of the dashed enclosure 01—01 in its preferred embodiment, and the emission of an audible alarm call sound 4—4 is shown as curved dashed lines, as generally designated.

Figure 2:
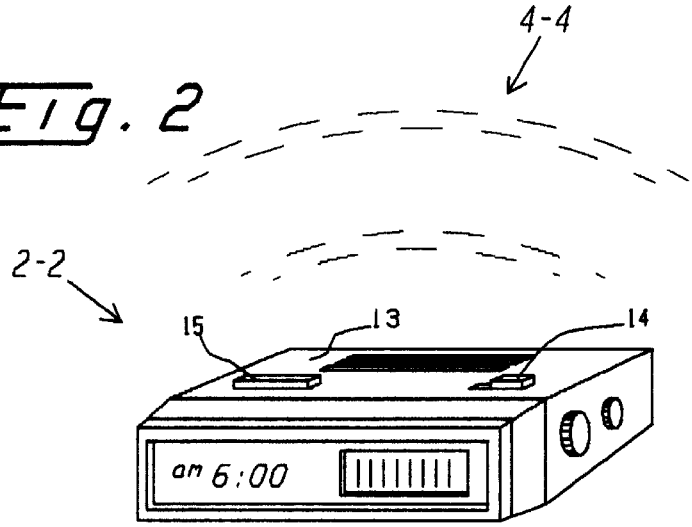
FIG. 2 is a projected front elevational view of a personal electronic clock radio device 2—2, as generally designated.

With attention also invited to FIG. 2 of the accompanying drawings, the personal electronic clock radio device 2—2 is shown more in detail, and the emission of the audible alarm call sound 4—4 is similarly represented as it may preliminarily be broadcast by the personal electronic clock radio device 2—2, according to the direction of the limited automatic multiple recall alarm suspension control means 3—3.

The personal electronic clock radio device 2—2 shown in FIGS. 1 and 2 of the accompanying drawings generally corresponding with such a device previously manufactured under the General Electric label, Model No. 7-4649B, merely as an example of such a device to which a limited automatic multiple recall alarm suspension control means 3—3 has accordingly been incorporated within.

With attention mainly on FIG. 1 of the accompanying drawings, the personal electronic clock radio device 2—2 having a standard line cord and plug arrangement 1 allowing power to be applied from a suitable power source to a power supply 2 included by the personal electronic clock radio device 2—2, providing various operating potentials. The personal electronic clock radio device 2—2 having clock/alarm circuitry 3, which is generally shown with the power supply 2, jointly situated in connection with the audio output control circuitry 4 of the personal electronic clock radio device 2—2.

The limited automatic multiple recall alarm suspension control means 3—3 is shown connected with the personal electronic clock radio device 2—2 by an input conductor 5, which Is coupled to an audio output control terminal 6 of the personal electronic clock radio device 2—2 in connection with internal audio alarm control means contained by the personal electronic clock radio device 2—2, residing within the audio output control circuitry 4 of the personal electronic clock radio device 2—2.

The input conductor 5 receiving an audio enabling potential (A) which is initiated by the internal audio alarm control means of the personal electronic clock radio device 2—2 for allowing the emission of sound to be produced by the personal electronic clock radio device 2—2.

The input conductor 5 is then coupled to a receiving terminal 7 of the limited automatic multiple recall alarm suspension control means 3—3 allowing the audio enabling potential (A) to be intercepted.

A separate output conductor 8 is coupled from a release terminal 9 of the limited automatic multiple recall alarm suspension control means 3—3 to a receiving terminal 10 of the personal electronic clock radio device 2—2, in connection with the radio/amplifier circuitry 11, and speaker 12, of the personal electronic clock radio device 2—2, which comprise the internal sound emission means of the personal electronic clock radio device 2—2.

The audio enabling potential (A) may then be discharged from the release terminal 9 of the limited automatic multiple recall alarm suspension control means 3—3, for allowing the audible alarm call sound 4—4 to be broadcast according to the direction of the limited automatic multiple recall alarm suspension control means 3—3.

With attention again on FIG. 2, the personal electronic clock radio device 2—2 having on its top panel 13 a selector switch 14, and a bar switch 15, included within the internal audio alarm control means of the personal electronic clock radio device 2—2, as previously existing control features of the personal electronic clock radio device 2—2.

Figure 6:
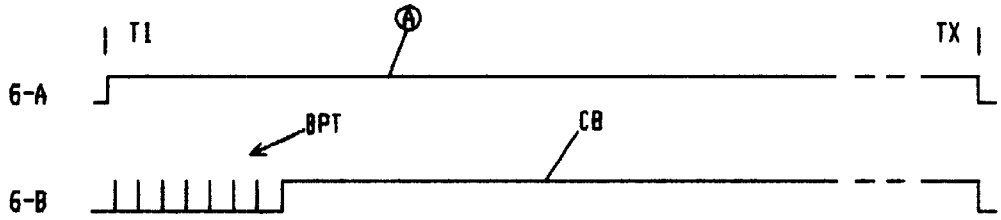
FIG. 6 is a chart diagram relating to the operation of the present invention 1—1.

The selector switch 14 may be positioned by the user at "Radio" to allow the audio enabling potential (A) to be manually initiated and the radio to be spontaneously played at any time, or the selector switch 14 may be positioned to allow the audio enabling potential (A) to be automatically initiated by the internal audio alarm control means of the personal electronic clock radio device 2—2 at a set time (T1), for an extended amount of time (TX), as generally represented in FIG. 6, 6-A, of the accompanying drawings, when positioned at either "Wake to Music" to allow the radio to be automatically played, or "Wake to Alarm" to allow the emission of the audible alarm call sound 4—4 to be automatically broadcast at the set time (T1), for the extended amount of time (TX) provided.

The selector switch 14 may alternatively be positioned at "Off" allowing the audio enabling potential (A) to be permanently withdrawn, to terminate the radio from being spontaneously or automatically played, and the emission of the audible alarm call sound 4—4 from being automatically broadcast.

The bar switch 15 may be manually depressed by the user to only temporarily withdraw the audio enabling potential (A) after it is automatically initiated to suspend the radio from being automatically played, or emission of the audible alarm call sound 4—4 from being automatically broadcast. The audio enabling potential (A) will then automatically be reinstated after the elapse of some period of time thereby allowing the radio to then resume to play, or the emission of the audible alarm call sound 4—4 to resume to be broadcast.

Figure 3:
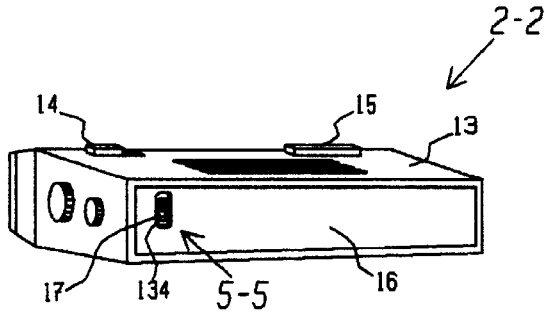
FIG. 3 is a projected rear elevational view of the personal electronic clock radio device 2—2 showing an added manual switching means 5—5, as generally designated.
Figure 4:
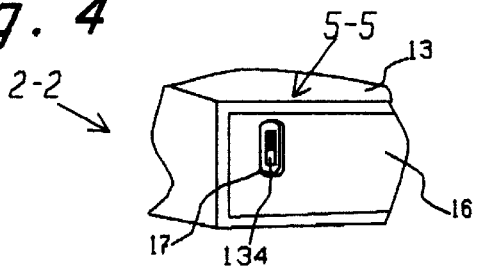
FIG. 4 is a rear detail view of the personal electronic clock radio device 2—2 showing the added manual switching means 5—5, as generally designated.

With attention continuing to FIGS. 3 and 4 of the accompanying drawings, an added manual switching means 5—5 is shown as generally designated, which may further be included by the limited automatic multiple recall alarm suspension control means 3—3 as a means for optionally allowing a personal electronic clock related device to be independently operated.

The added manual switching means 5—5 is shown in the dashed enclosure 02—02 located within the rear panel 16 of the personal electronic clock radio device 2—2 accessible to the user, and may be positioned through an opening 17 at "On" for allowing the personal electronic clock radio device 2—2 to be unaffected by the limited automatic multiple recall alarm suspension control means 3—3, for example, at times when the radio is played, or when the emission of the audible alarm call sound 4—4 is desired to be conventionally broadcast.

The added manual switching means 5—5 may normally however be positioned at "Off" when the audible alarm call sound 4—4 is to be broadcast, for allowing the emission of the audible alarm call sound 4—4 to be broadcast according to the direction of the limited automatic multiple recall alarm suspension control means 3—3.

The emission of the audible alarm call sound 4—4 may therefore be terminated when it is broadcast according to the direction of the limited automatic multiple recall alarm suspension control means 3—3 at any time by the user after it has once been invoked by positioning the selector switch 14 to "Off," or the emission of the audible alarm call sound 4—4 may be manually suspended by depressing the bar switch 15, whereupon, it would cease to be broadcast for some period of time, and may then be repeated to be broadcast as it was previously broadcast from the beginning.

The operation of the invention will be hereinafter more fully described in the following detailed description and operation of the invention.

DETAILED DESCRIPTION AND OPERATION OF THE INVENTION

In the following it will be assumed the selector switch 14 shown in FIG. 2 has been positioned as previously described to allow the audible alarm call sound 4—4 to be broadcast.

Figure 9:
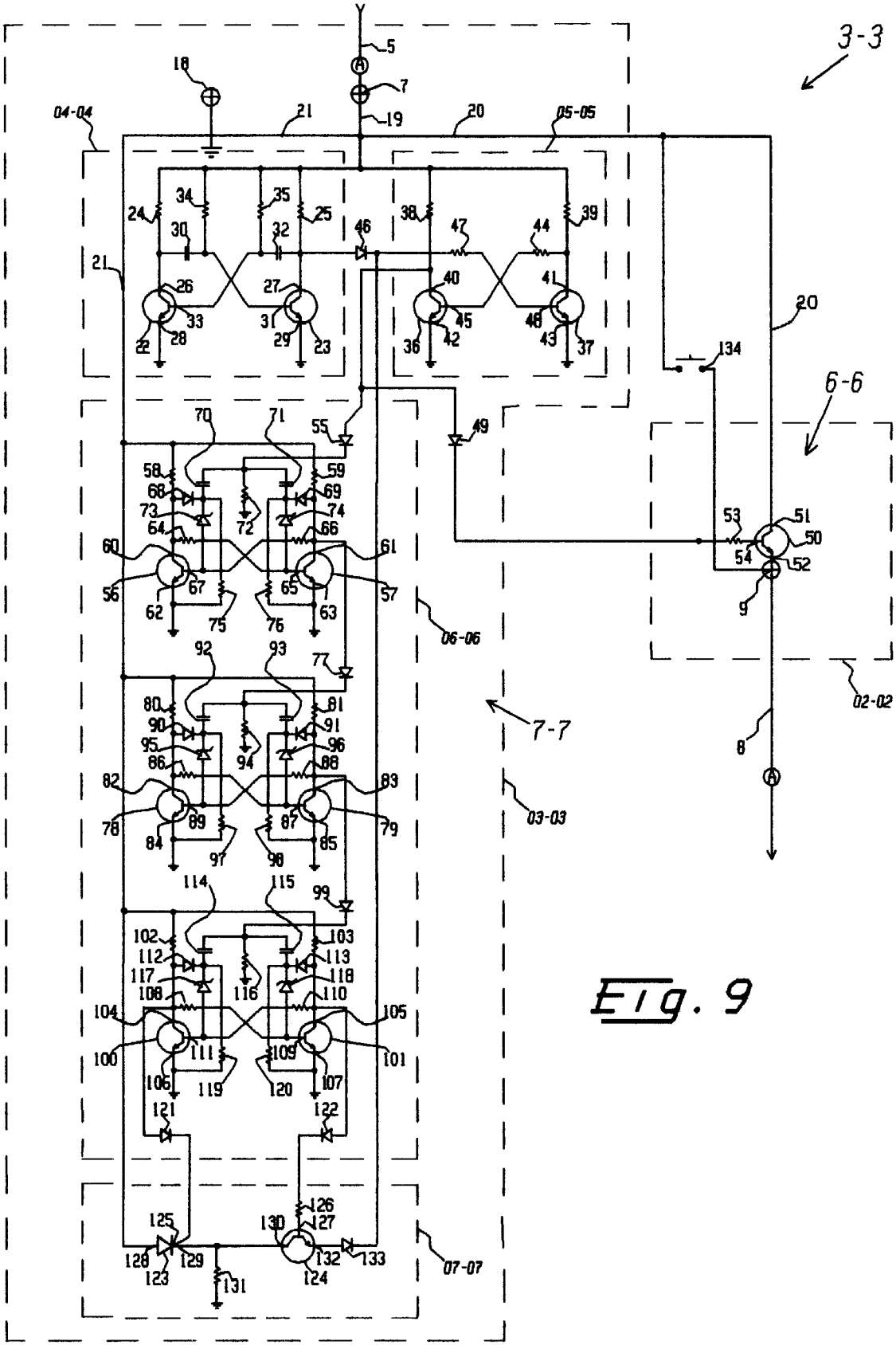
FIG. 9 is a detailed electronic diagram of a limited automatic multiple recall alarm suspension control means 3—3 relating to the present invention 1—1, as generally designated.
Figure 1:
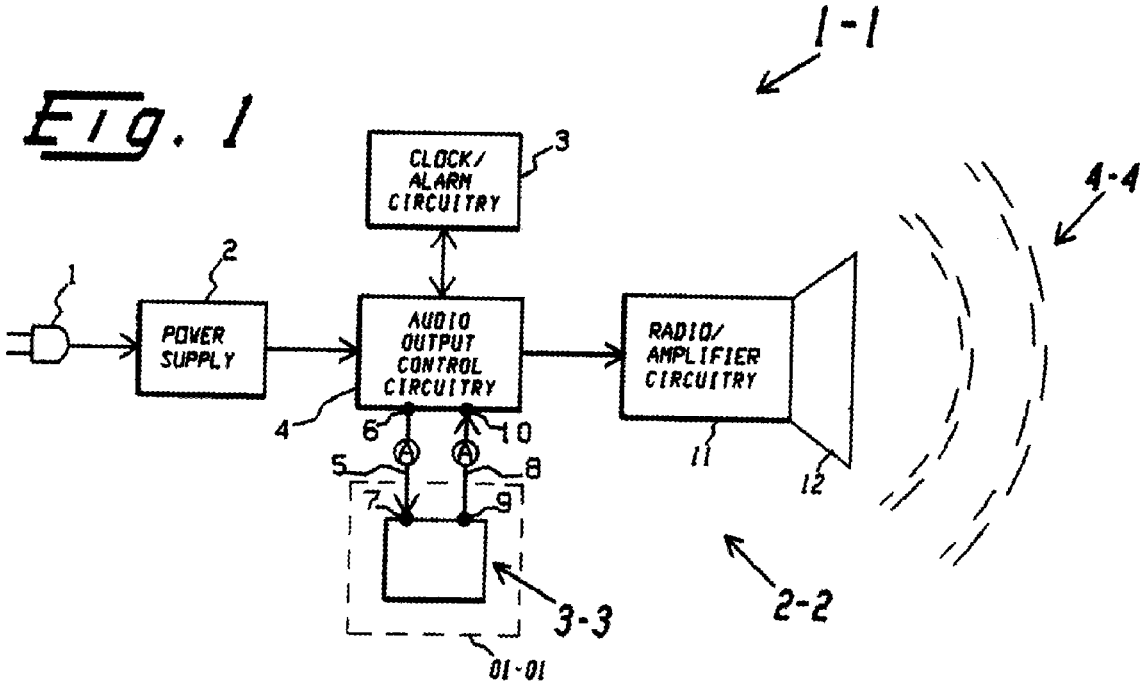

With attention now invited to FIG. 9 of the accompanying drawings, the limited automatic multiple recall alarm suspension control means 3—3 is shown in detail comprising an involuntary alarm suspension control circuit which may be coupled with the personal electronic clock radio device 2—2 by the input conductor 5, and separate output conductor 8. Also, an internal grounding lug 18, of the personal electronic clock radio device 2—2 is shown indicating the limited automatic multiple recall alarm suspension control means 3—3 is commonly connected, therewith.

The audio enabling potential (A) is initiated at a set time (T1) when the audible alarm call sound 4—4 is broadcast, as generally shown in FIG. 6, 6-A, of the accompanying drawings, and distributed throughout by a plurality of universal voltage potential conductors 19,20,21.

The limited automatic multiple recall alarm suspension control means 3—3 including an extended audio control means 6—6 shown within the dashed enclosure 03—03, and a governing means 7—7, oppositely shown within the dashed enclosure 04—04, as generally designated.

The extended audio control means 6—6 is coupled in connection with the internal audio alarm control means of the personal electronic clock radio device 2—2 by the input conductor 5, and receives the audio enabling potential (A) from the universal voltage potential conductors 19, and 20, and is arranged to allow it to be immediately cut off.

The extended audio control means 6—6 is then further coupled in connection with the internal sound emission means of the personal electronic clock radio device 2—2 by the separate output conductor 8, interrupting the emission of the audible alarm call sound 4—4 from being broadcast.

The governing means 7—7 is jointly coupled in connection with the internal audio alarm control means of the personal electronic clock radio device 2—2, and is then simultaneously activated when the audio enabling potential (A) is received from the universal voltage potential conductors 19, and 21, when the audible alarm call sound 4—4 is to be broadcast.

The governing means 7—7 including primary and secondary output control means cooperatively allowing an involuntary control signal to be discharged.

The extended audio control means 6—6 is then further coupled in connection with and activated by the involuntary control signal for allowing the emission of the audible alarm call sound 4—4 to be broadcast, as will be more fully hereinafter described.

With attention remaining on FIG. 9 of the accompanying drawings, the primary output control means including a multivibrator circuit, shown within the dashed enclosure 05—05, and a schmitt triggering type circuit, shown within the dashed enclosure 06—06.

The multivibrator circuit being of a common variety having a first and second transistor 22,23, of the NPN type, with load resistors 24,25 coupled from the universal voltage potential conductor 19 to their collector electrodes 26,27, and their emitter electrodes 28,29 connected to ground resistance.

The multivibrator circuit having internal resistance and capacitance biasing means including a first capacitor 30 cross coupled from the collector electrode 26 of the first transistor 22 to the base electrode 31 of the second transistor 23, and a second capacitor 32 cross coupled from the collector electrode 27 of the second transistor 23 to the base electrode 33 of the first transistor 22. A first biasing resistor 34, providing a substantially low resistance to a voltage potential, is coupled from the universal voltage potential conductor 19 to the first capacitor 30 in connection with the base electrode 31 of the second transistor 23, and a second biasing resistor 35, providing an extremely high resistance to a voltage potential, is coupled from the universal voltage potential conductor 19 to the second capacitor 32 in connection with the base electrode 33 of the first transistor 22.

Figure 5:
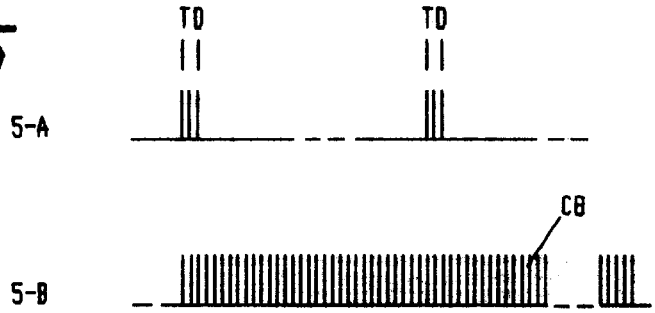
FIG. 5 is a chart diagram relating to the operation of the present invention 1—1.

When the audio enabling potential (A) is received, the audio enabling potential (A) comprises a voltage potential and the first and second transistor 22,23 alternate between conducting and nonconducting states in the usual fashion, however, an output potential is then very infrequently emitted for extremely brief durations of time (TD) due to the specified arrangement of the internal resistance and capacitance biasing means of the multivibrator circuit, which is taken from the collector electrode 27 of the second transistor 23 when it is not conducting, generally corresponding with FIG. 5, 5-A, of the accompanying drawings.

The schmitt triggering type circuit having a first and second transistor 36,37, of the NPN type, with load resistors 38,39 coupled from the universal voltage potential conductor 19 to their collector electrodes 40,41, and their emitter electrodes 42,43 connected to ground resistance. A biasing resistor 44 is then cross coupled from the collector electrode 41 of the second transistor 37 to the base electrode 45 of the first transistor 36.

The output potential from the multivibrator circuit is discharged to a blocking diode 46, coupled from the collector electrode 27 of the second transistor 23 to a biasing resistor 47, and the biasing resistor 47 is further coupled to the base electrode 48 of the second transistor 37 in the schmitt triggering type circuit.

Initially, the first transistor 36 in the schmitt triggering type circuit is conducting, and the second transistor 37 is not conducting.

When the output potential from the multivibrator circuit is applied to the base electrode 48 of the second transistor 37, the second transistor 37 is made to conduct, and the first transistor 36 is abruptly cut off, allowing an involuntary control signal to be emitted from the collector electrode 40 of the first transistor 36, when it is not conducting.

The involuntary control signal from the schmitt triggering type circuit is discharged to an isolation diode 49, coupled to the collector electrode 40 of the first transistor 36.

The extended audio control means 6—6 comprising an audio output control transistor 50, of the NPN type, coupled with the universal voltage potential conductor 20 at its collector electrode 51, and further coupled at its emitter electrode 52 to the release terminal 9.

At the offset the audio output control transistor 50 is not conducting, and when the audio enabling potential (A) is received, it is immediately cut off interrupting the audible alarm call sound 4—4 from being broadcast.

The isolation diode 49 is then coupled to a biasing resistor 53, which is in turn coupled to the base electrode 54 of the audio output control transistor 50, as shown.

The audio output control transistor 50 is accordingly coupled in connection with and activated by the involuntary control signal for allowing the emission of the audible alarm call sound 4—4 to be broadcast when the involuntary control signal is applied to its base electrode 54, thereby allowing the audio enabling potential (A) to be released, and the emission of the audible alarm call sound 4—4 to be broadcast when the audio enabling potential (A) is allowed to continue internally within the personal electronic clock radio device 2—2.

Figure 8:
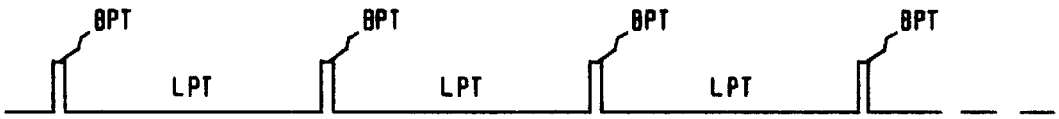
FIG. 8 is a chart diagram relating to the operation of the present invention 1—1.

Therefore, the primary output control means are consequently arranged specifically allowing the audible alarm call sound 4—4 to be very infrequently momentarily broadcast for extremely brief periods of time (BPT), as shown in detail in FIG. 8 of the accompanying drawings.

A second isolation diode 55 is jointly coupled with the collector electrode 40 of the first transistor 36 in the schmitt triggering type circuit, also receiving the involuntary control signal when discharged.

The secondary output control means then including counting means comprising a series of flip-flop type circuits, shown within the dashed enclosure 07—07, and a latching circuit, shown within the area of the dashed enclosure 08—08.

The first flip-flop type circuit including a first and second transistor 56,57, of the NPN type, having a first and second load resistor 58,59 coupled from the universal voltage potential conductor 21 to their collector electrodes 60,61, and their emitter electrodes 62,63 connected to ground resistance.

The second load resistor 59 providing a lower resistance to a voltage potential.

A biasing resistor 64 is cross coupled from the collector electrode 60 of the first transistor 56 to the base electrode 65 of the second transistor 57, and a similar biasing resistor 66 is cross coupled from the collector electrode 61 of the second transistor 57 to the base electrode 67 of the first transistor 56.

At the offset when the audio enabling potential (A) is received, the first transistor 56 is made to conduct harder and the second transistor 57 is cut off, primarily due to the mismatch of the a first and second load resistor 58,59.

Charging diodes 68,69 are coupled from the collector electrode 60,61 of the first and second transistor 56,57 to a first and second switching capacitor 70,71. The first and second switching capacitor 70,71 are further coupled to a common grounding resistor 72, which is therefrom connected to ground resistance, as shown.

When the second transistor 57 is not conducting, the voltage potential at its collector electrode 61 is high, and the second switching capacitor 71 is charged from the charging diode 69.

Zenner diodes 73,74, and sinking resistors 75,76, are additionally coupled with the charging diodes 68,69, and first and second switching capacitors 70,71. The zenner diodes 73,74 are further coupled to the base electrodes 65,67 of the first and second transistor 56,57, and the sinking resistors 75,76 are further coupled to ground resistance, as shown.

When the second capacitor 71 is charged any substantial amount of voltage is prevented from being applied to the base electrode 65 of the second transistor 57 by the zenner diode 74, while voltage in the first capacitor 70 may be drained by the sinking resistor 75.

The second isolation diode 55 is thereafter further coupled with the first and second switching capacitor 70,71, as shown, and when the involuntary control signal is discharged the voltage potential in the first and second capacitor 70,71 is raised by the potential value of the involuntary control signal and forced to overcome the zenner diode 73, and 74, and be applied to the base electrodes 65,67 of the first and second transistor 56,57.

At this time the voltage stored in the second capacitor 71 is far greater than that in the first capacitor 70, and the second transistor 57 is made to conduct harder, causing the first transistor 56 to be cut off.

When the first transistor 56 is cut off, the first capacitor 70 is in turn charged from the charging diode 68, and the first transistor 56 is then subsequently made to conduct harder in a manner similar to that of the second transistor 57 when the involuntary control signal is applied.

Each time the involuntary control signal is received, it acts as a switching potential and the first and second transistors 56,57 alternate between conducting and nonconducting states, allowing an ensuing switching potential to be taken from the collector electrode 61 of the second transistor 57 when it is not conducting.

The second and third flip-flop type circuits are consecutively coupled, and include elements from 78 to 120 identical to those of the first flip-flop type circuit, and operate in a similar manner.

The ensuing switching potential from the first flip-flop type circuit is emitted to an isolation diode 77, coupled from the collector electrode 61 of the second transistor 57 to the first and second switching capacitor 92,93 in the second flip-flop type circuit. A following switching potential from the second flip-flop type circuit is then emitted to an isolation diode 99, similarly coupled from the collector electrode 83 of the second transistor 79 to the first and second switching capacitor 114,115 in the third flip-flop type circuit, as shown.

Final override potentials are then alternately emitted by the first and second transistor 100,101 in the third flip-flop type circuit to isolation diodes 121,122.

The latching circuit primarily including a silicone controlled rectifier 123, and an override transistor 124, of the NPN type.

The isolation diode 121 is then coupled from the collector electrode 104 of the first transistor 100 in the third flip-flop type circuit to the gate electrode 125 of the silicone controlled rectifier 123, and the isolation diode 122 is coupled from the collector electrode 105 of the second transistor 101 to a biasing resistor 126, further coupled in connection with the base electrode 127 of the override transistor 124, as shown.

The universal voltage potential conductor 21 is then coupled to the anode electrode 128, of the silicone controlled rectifier 123, and the cathode electrode 129 of the silicone controlled rectifier 123 is coupled to the collector electrode 130 of the override transistor 124.

At the offset when the audio enabling potential (A) is received the silicone controlled rectifier 123 is cut off, and the override transistor 124 is conducting, however, the emission of the audible alarm call sound 4—4 is not noticeably affected since the voltage potential from the universal voltage potential conductor 21 is halted by the silicone controlled rectifier 123.

When the audible alarm call sound 4—4 has been broadcast, and the involuntary control signal has been applied to the first flip-flop type circuit a number of times, the silicone controlled rectifier 123 is sequentially made to conduct, however, the override transistor 124 is in turn cut off, preventing any substantial voltage potential from continuing further, and the emission of the audible alarm call sound 4—4 from being noticeably affected.

A load resistor 131 is additionally included coupled from the cathode electrode 129 of the silicone controlled rectifier 123 to ground resistance, allowing the silicone controlled rectifier 123 to be held in a conducting state after it has once been made to conduct.

After the audible alarm call sound 4—4 has been broadcast, and the involuntary control signal has been applied to the first flip-flop type circuit a further number of times, the override transistor 124 is then sequentially made to conduct again, and the silicone controlled rectifier 123 is held conducting by the load resistor 131.

An isolation diode 133 is then coupled as shown from the emitter electrode 132 of the override transistor 124 in connection with the base electrode 48, of the second transistor 37 in the schmitt triggering type circuit.

The involuntary control signal may then be discharged in response to the voltage potential from the override transistor 124 causing a "latched condition" to exist, which in turn allows the emission of the audible alarm call sound 4—4 to be continuously broadcast (CB) until otherwise interrupted, as generally represented in FIG. 5, 5-B, and 6, 6-B, of the accompanying drawings.

Where accordingly, the primary output control means are arranged specifically allowing the audible alarm call sound 4—4 to be very infrequently momentarily broadcast for extremely brief periods of time (BPT), as shown more in detail in FIG. 8 of the accompanying drawings.

The secondary output control means allowing the audible alarm call sound 4—4 to be continuously broadcast (CB) after the audible alarm call sound 4—4 has been accordingly broadcast a preceding number of times, as generally shown for example in FIGS. 6, 6-B, and 7, of the accompanying drawings.

Figure 7:
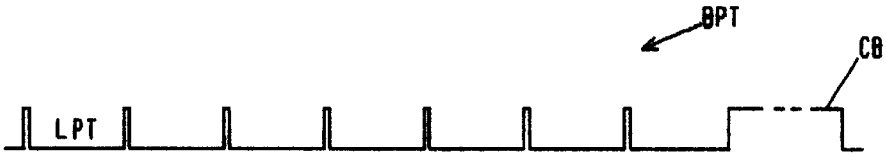
FIG. 7 is a chart diagram relating to the operation of the present invention 1—1.

The limited automatic multiple recall alarm suspension control means 3—3 therefore consistently allowing the emission of the audible alarm call sound 4—4 produced by a personal electronic clock related device to be momentarily broadcast and then involuntarily suspended for a substantially lengthy period of time (LPT) for a limited number of times prior to being continuously broadcast (CB), according to the direction of the limited automatic multiple recall alarm suspension control means 3—3, as generally shown for example in greater detail in FIGS. 7, and 8, of the accompanying drawings.

The added manual switching means 5—5 generally designated in FIG. 3, and 4, of the accompanying drawings, comprising a manual bypass switch 134 additionally coupled from the universal voltage potential conductor 20 in connection with the internal audio alarm control means, and further coupled to the release terminal 9 of the limited automatic multiple recall alarm suspension control means 3—3, in connection with the internal sound emission means of the personal electronic clock radio device 2—2, which may be positioned at "On," to conduct, and allow the audio enabling potential (A) to immediately routinely continue internally within the personal electronic clock radio device 2—2, for optionally allowing the personal electronic clock radio device 2—2 to be independently operated. The manual bypass switch 134 may normally however be positioned at "Off," not to conduct, allowing the audio enabling potential (A) to be immediately cut off by the audio output control transistor 50, when the audible alarm call sound 4—4 is to be broadcast, for subsequently allowing the emission of the audible alarm call sound 4—4 to be broadcast according to the direction of the limited automatic multiple recall alarm suspension control means 3—3.

When emission of the audible alarm call sound 4—4 is broadcast according to the direction of the limited automatic multiple recall alarm suspension control means 3—3 and then suspended by depressing the bar switch 15, the audio enabling potential (A) is temporarily withdrawn causing the "latched condition" previously related upon not to exist. When the audio enabling potential (A) is reinstated the emission of the audible alarm call sound 4—4 may then be repeated to be broadcast as it was previously broadcast from the beginning.

This invention is therefore intended to allow users to possibly avoid the annoyance or minor aggravation which they may have often previously encountered described in the foregoing during the use of personal electronic clock related devices. Since numerous modifications and changes will become readily apparent to those skilled in the art, the foregoing is considered as illustrative only, and accordingly, all suitable equivalents may be resorted to falling within the spirit and scope of the invention.

What is claimed is:

1. The combination of a personal electronic clock related device with a limited automatic multiple recall alarm suspension control means comprising an involuntary alarm suspension control circuit, said involuntary alarm suspension control circuit including an extended audio control means and a governing means, said personal electronic clock related device having internal audio alarm control means and internal sound emission means for allowing the emission of an audible alarm call sound to be broadcast at a set time, said extended audio control means coupled in connection with said internal audio alarm control means, and further coupled in connection with said internal sound emission means interrupting the emission of said audible alarm call sound from being broadcast, said governing means jointly coupled in connection with said internal audio alarm control means and simultaneously activated when said audible alarm call sound is to be broadcast, said governing means including primary and secondary output control means cooperatively allowing an involuntary control signal to be discharged, said extended audio control means further coupled in connection with and activated by said involuntary control signal for allowing the emission of said audible alarm call sound to be broadcast, said primary output control means arranged specifically allowing said audible alarm call sound to be very infrequently momentarily broadcast for extremely brief periods of time, said secondary output control means allowing said audible alarm call sound to be continuously broadcast after said audible alarm call sound has been accordingly broadcast a preceding number of times, whereby, for consistently allowing the emission of said audible alarm call sound produced by said personal electronic clock related device to be momentarily broadcast and then involuntarily suspended for a substantially lengthy period of time for a limited number of times prior to being continuously broadcast, according to the direction of said limited automatic multiple recall alarm suspension control means.

2. The combination of claim 1, wherein, said limited automatic multiple recall alarm suspension control means may further include a means additionally coupled in connection with said internal audio alarm control means, and further coupled in connection with said internal sound emission means of said personal electronic clock related device, for optionally allowing said personal electronic clock related device to be independently operated.

3. The combination of a personal electronic clock related device with a limited automatic multiple recall alarm suspension control means comprising an involuntary alarm suspension control circuit, said involuntary alarm suspension control circuit primarily including an extended audio control means and a governing means, said personal electronic clock related device having internal audio alarm control means and internal sound emission means for allowing the emission of an audible alarm call sound to be broadcast at a set time, said extended audio control means coupled in connection with said internal audio alarm control means, and further coupled in connection with said internal sound emission means interrupting the emission of said audible alarm call sound from being broadcast, said governing means jointly coupled in connection with said internal audio alarm control means and simultaneously activated when said audible alarm call sound is to be broadcast, said governing means including primary and secondary output control means cooperatively allowing an involuntary control signal to be discharged, said extended audio control means further coupled in connection with and activated by said involuntary control signal for allowing the emission of said audible alarm call sound to be broadcast, said primary output control means arranged specifically allowing said audible alarm call sound to be very infrequently momentarily broadcast for extremely brief periods of time, said secondary output control means allowing said audible alarm call sound to be continuously broadcast after said audible alarm call sound has been accordingly broadcast a preceding number of times, a means further included by said limited automatic multiple recall alarm suspension control means additionally coupled in connection with said internal audio alarm control means, and further coupled in connection with said internal sound emission means of said personal electronic clock related device, for optionally allowing said personal electronic clock related device to be independently operated.

* * * * *

UNITED STATES PATENT AND TRADEMARK OFFICE

CERTIFICATE OF CORRECTION

PATENT NO. : 5,886,955
DATED : March 23, 1999
INVENTOR(S) : Peter L. Magnasco

It is certified that error appears in the above-identified patent and that said Letters Patent is hereby corrected as shown below:

Col. 4, line 59-60, delete "in the dashed enclosure 02-02."

Col. 5, line 43, change "dashed enclosure 03-03" to "__ dashed enclosure 02-02 __."

Col. 5, line 45, change "dashed enclosure 04-04" to "__ dashed enclosure 03-03 __."

Col. 6, line 8-9, change "dashed enclosure 05-05" to "__ dashed enclosure 04-04 __."

Col. 6, line 10, change "dashed enclosure 06-06" to "__ dashed enclosure 05-05 __."

Col. 7, line 34, change "dashed enclosure 07-07" to "__ dashed enclosure 06-06 __."

Col. 7, line 35-36, change "dashed enclosure 08-08" to "__ dashed enclosure 07-07 __."

Signed and Sealed this

Second Day of January, 2001

*Attest:*

*Attesting Officer*

Q. TODD DICKINSON

*Commissioner of Patents and Trademarks*

UNITED STATES PATENT AND TRADEMARK OFFICE

CERTIFICATE OF CORRECTION

PATENT NO. : 5,886,955
APPLICATION NO. : 08/326937
DATED : March 23, 1999
INVENTOR(S) : Peter L. Magnasco It is certified that error appears in the above-identified patent and that said Letters Patent is hereby corrected as shown below:

The title page should be deleted to appear as per attached title page

The sheet of drawings consisting of figure 1 should be deleted to appear as per attached figure one Column 5, line 43, insert --__comprising an involuntary alarm suspension control circuit__-- before the words "including an"

Column 8, line 6, change "second capacitor 71" to --__second switching capacitor 71__--

Column 8, line 9, change "first capacitor 70" to --__first switching capacitor 70__--

Column 8, line 14-15, change "first and second capacitor 70, 71" to --__first and second switching capacitor 70, 71__--

Column 8, line 19, change "second capacitor 71" to --__second switching capacitor 71__--

Column 8, line 20, change "first capacitor 70" to --__first switching capacitor 70__--

Column 8, line 23, change "first capacitor 70" to --__first switching capacitor 70__--

Signed and Sealed this

Eighteenth Day of November, 2008

JON W. DUDAS
*Director of the United States Patent and Trademark Office*

United States Patent [19]

Magnasco

[11] Patent Number: 5,886,955

[45] **Date of Patent: *Mar. 23, 1999**

[54] PERSONAL ELECTRONIC CLOCK RELATED DEVICE WITH A LIMITED AUTOMATIC MULTIPLE RECALL ALARM SUSPENSION CONTROL MEANS

[76] Inventor: Peter L. Magnasco, P.O. Box 173, Campbell, Calif. 95009

[ * ] Notice: This patent issued on a continued prosecution application filed under 37 CFR 1.53(d), and is subject to the twenty year patent term provisions of 35 U.S.C. 154(a)(2).

[21] Appl. No.: 326,937

[22] Filed: Oct. 21, 1994

[51] Int. Cl.[6] ..... G04B 22/08

[52] U.S. Cl. ..... 368/248; 368/244

[58] Field of Search ..... 368/245, 256, 368/248–279

[56] References Cited

U.S. PATENT DOCUMENTS

| | | | |
|---|---|---|---|
| 1,858,563 | 5/1932 | Schlenker | 368/245 |
| 3,681,916 | 8/1972 | Itoyama et al. | 368/245 |
| 3,715,879 | 2/1973 | Cielaszyk | 368/248 |
| 3,733,802 | 5/1973 | Wisser | 368/248 |
| 3,825,836 | 7/1974 | Pyles | 325/396 |
| 3,855,574 | 12/1974 | Welty | 368/248 |
| 3,900,798 | 8/1975 | Pomerantz et al. | 325/396 |
| 4,060,973 | 12/1977 | Martino | 368/245 |
| 4,426,736 | 1/1984 | Fisler | 455/231 |

FOREIGN PATENT DOCUMENTS

| | | | |
|---|---|---|---|
| 0339316 | 11/1989 | European Pat. Off. | 368/245 |
| 1903715 | 8/1970 | Germany | 368/248 |
| 2615945 | 10/1977 | Germany | 368/248 |
| 0044575 | 4/1979 | Japan | 368/248 |
| 0122983 | 9/1981 | Japan | 368/256 |
| 0088679 | 5/1984 | Japan | 368/248 |
| 01424487 | 6/1989 | Japan | 368/245 |
| 0143996 | 6/1989 | Japan | 368/245 |

*Primary Examiner*—Bernard Roskoski

[57] ABSTRACT

The combination of a personal electronic clock related device with a limited automatic multiple recall alarm suspension control means comprising an involuntary alarm suspension control circuit including an extended audio control means and a governing means. The personal electronic clock related device having internal audio alarm control means and internal sound emission means for allowing the emission of an audible alarm call sound to be broadcast at a set time. The extended audio control means is coupled with the internal audio alarm control means, and further coupled with the internal sound emission means interrupting the emission of the audible alarm call sound from being broadcast. The governing means is jointly coupled with the internal audio alarm control means and simultaneously activated when the audible alarm call sound is to be broadcast. The governing means including primary and secondary output control means cooperatively allowing an involuntary control signal to be discharged. The extended audio control means is further coupled in connection with and activated by the involuntary control signal for allowing the emission of the audible alarm call sound to be broadcast. The primary output control means are arranged specifically allowing the audible alarm call sound to be very infrequently momentarily broadcast for extremely brief periods of time. The secondary output control means allowing the audible alarm call sound to be continuously broadcast after the audible alarm call sound has been accordingly broadcast a preceding number of times, whereby, for consistently allowing the emission of the audible alarm call sound produced by the personal electronic clock related device to be momentarily broadcast and then involuntarily suspended for a substantially lengthy period of time for a limited number of times prior to being continuously broadcast, according to the direction of the limited automatic multiple recall alarm suspension control means. The limited automatic multiple recall alarm suspension control means may further include a means for optionally allowing the personal electronic clock related device to be independently operated.

3 Claims, 3 Drawing Sheets

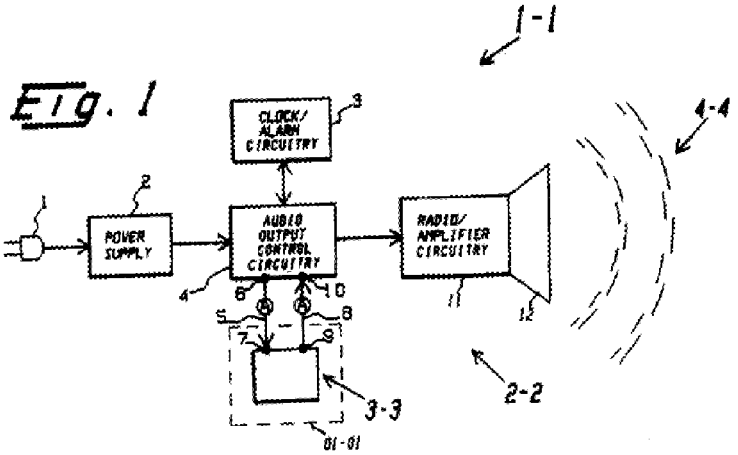

1-1
CLOCK/ ALARM CIRCUITRY
3
4-4
1
2
POWER SUPPLY
AUDIO OUTPUT CONTROL CIRCUITRY
RADIO/ AMPLIFIER CIRCUITRY
4
6
10
5
8
7
9
11
12
3-3
2-2
01-01